US007887332B2

(12) United States Patent
Bauer et al.

(10) Patent No.: US 7,887,332 B2
(45) Date of Patent: Feb. 15, 2011

(54) SYSTEM AND METHOD FOR ROTATABLE INFORMATION HANDLING SYSTEM POWER CABLE CONNECTION

(75) Inventors: John Bauer, Austin, TX (US); Mark Schwager, Round Rock, TX (US)

(73) Assignee: Dell Products L.P., Round Rock, TX (US)

( * ) Notice: Subject to any disclaimer, the term of this patent is extended or adjusted under 35 U.S.C. 154(b) by 43 days.

(21) Appl. No.: 12/388,591

(22) Filed: Feb. 19, 2009

(65) Prior Publication Data

US 2010/0210119 A1 Aug. 19, 2010

(51) Int. Cl.
*H01R 39/00* (2006.01)

(52) U.S. Cl. ..... 439/13; 439/131

(58) Field of Classification Search ..... 439/131, 439/13

See application file for complete search history.

(56) References Cited

U.S. PATENT DOCUMENTS 4,699,591 A 10/1987 Gallo et al.
5,266,059 A 11/1993 Taylor
5,535,093 A 7/1996 Noguchi et al.
6,093,038 A * 7/2000 Chen et al. ..... 439/131
6,873,808 B2 * 3/2005 Ueda ..... 399/90
7,374,437 B2 * 5/2008 Reid et al. ..... 439/131
7,435,091 B1 10/2008 Cruz
7,540,748 B2 * 6/2009 Tracy et al. ..... 439/131
2008/0211321 A1 9/2008 Liao
2009/0029577 A1 * 1/2009 Grems et al. ..... 439/131

* cited by examiner

*Primary Examiner*—Tho D Ta
(74) *Attorney, Agent, or Firm*—Hamilton & Terrile, LLP; Robert W. Holland

(57) ABSTRACT

A power connects at an information handling system housing through a rotational connector that allows the power cable to align with plural axes relative to the housing. For example, force applied to the cable causes the rotational connector to rotate from a rear surface of the housing to a side surface or bottom surface of the housing. Excessive force results in a breakaway mechanism releasing the rotational connector from the housing so that the connector and internal power subsystem components avoid damage.

5 Claims, 3 Drawing Sheets

SYSTEM AND METHOD FOR ROTATABLE INFORMATION HANDLING SYSTEM POWER CABLE CONNECTION

BACKGROUND OF THE INVENTION

1. Field of the Invention

The present invention relates in general to the field of information handling system cable connections, and more particularly to a system and method for rotatable information handling system power cable connection.

2. Description of the Related Art

As the value and use of information continues to increase, individuals and businesses seek additional ways to process and store information. One option available to users is information handling systems. An information handling system generally processes, compiles, stores, and/or communicates information or data for business, personal, or other purposes thereby allowing users to take advantage of the value of the information. Because technology and information handling needs and requirements vary between different users or applications, information handling systems may also vary regarding what information is handled, how the information is handled, how much information is processed, stored, or communicated, and how quickly and efficiently the information may be processed, stored, or communicated. The variations in information handling systems allow for information handling systems to be general or configured for a specific user or specific use such as financial transaction processing, airline reservations, enterprise data storage, or global communications. In addition, information handling systems may include a variety of hardware and software components that may be configured to process, store, and communicate information and may include one or more computer systems, data storage systems, and networking systems.

Portable information handling systems have enjoyed growing acceptance among end users due in part to their convenience. Portable information handling systems are typically capable of operating free from any permanent connections, such as power, I/O device and networking connections. A typical portable information handling system includes an integrated liquid crystal display (LCD), integrated keyboard and integrated power source. The integrated display is typically built into a housing having a clam shell configuration that opens to present the display and an integrated keyboard and that closes to protect the display and keyboard when not in use. The integrated power source is typically a rechargeable battery that provides direct current (DC) power for a limited period of time and then requires recharging. An integrated wireless network interface card (NIC) is usually included in the housing to allow the information handling system to communicate with wireless networks. During portable operations, an end user opens the housing to expose the display and keyboard, powers up with the internal battery and communicates with the wireless NIC. The end user can use external resources by connecting cables for the external resources with portable housing. The most common connection is with a power cable so that the internal battery has an opportunity to recharge when external power is available. Other external resources that can connect with cables include peripheral keyboards, mice, displays and network connections, such as an Ethernet Cat 5 cable.

One difficulty with portable information handling systems is that portable systems are sometimes less robust than stationary systems, such as desktop information handling systems. In order to minimize the size and weight of portable systems, smaller, lighter and less bulky components are used than are available for stationary systems. The use of smaller components increases the flexibility and convenience of a portable system by making the system easier to carry and less awkward to use. However, smaller and lighter components tend to break more easily than the larger and heavier components available in stationary systems. Further, portable systems are often subjected to more physical shocks than are stationary systems because portable systems are carried into and used in a wide variety of environments. One example of this is the connector located at the portable system's housing for connecting to an external power adapter. The connector has to selectively couple and decouple with an external adapter and is also subjected to inadvertently applied forces when an end user moves the portable system about with the adapter connected. For example, an external power source may be located in a number of different directions depending upon the orientation of the end user relative to the power source. In some instances, a power connector located at the back of the housing is most convenient while, in other instance, a power connector located at a side surface is most convenient. If too much force is applied at a power connector, a failure may occur that prevents the application of external power to the information handling system, essentially making the system unusable.

SUMMARY OF THE INVENTION

Therefore a need has arisen for a system and method which manages force applied to an information handling system connector to reduce the risk of failure of the connector.

In accordance with the present invention, a system and method are provided which substantially reduce the disadvantages and problems associated with previous methods and systems for managing information handling system cable connections. A rotational connector at an information handling system housing couples with a cable at a selectable axis by rotating relative to the housing.

More specifically, an information handling system has plural processing components disposed in a housing that cooperate to process information, such as a CPU and RAM. Power to operate the processing components is provided through a cable from an external power source, such as an AC electrical outlet that provides power to an AC-to-DC adapter. A power cable from the AC-to-DC adapter couples to a rotational power connector, which provides power to a power subsystem of the information handling system. The rotational power connector rotates about a vertical and/or horizontal axis so that the power cable aligns between a position perpendicular to a side surface, rear surface or bottom surface of the housing. A breakaway mechanism associated with the rotational power connector releases the rotational power connector from the information handling system if a breakaway force is applied at the cable.

The present invention provides a number of important technical advantages. One example of an important technical advantage is that a power cable interfaces with an information handling system housing at multiple angles, such as the rear, side and bottom of the housing. Rotation of the power cable connector at the information handling system housing helps prevent damage to the connector and underlying electronic components within the housing in the event that a lateral force is applied at the connector by movement of the housing by an end user. Breakaway protection incorporated in the rotating power cable connector helps to ensure that the connector is not damaged if an excessive force is applied.

BRIEF DESCRIPTION OF THE DRAWINGS

The present invention may be better understood, and its numerous objects, features and advantages made apparent to those skilled in the art by referencing the accompanying drawings. The use of the same reference number throughout the several figures designates a like or similar element.

DETAILED DESCRIPTION

A rotational power connector provides multiples axes for an information handling system to receive a power cable, improving flexibility of operation. For purposes of this disclosure, an information handling system may include any instrumentality or aggregate of instrumentalities operable to compute, classify, process, transmit, receive, retrieve, originate, switch, store, display, manifest, detect, record, reproduce, handle, or utilize any form of information, intelligence, or data for business, scientific, control, or other purposes. For example, an information handling system may be a personal computer, a network storage device, or any other suitable device and may vary in size, shape, performance, functionality, and price. The information handling system may include random access memory (RAM), one or more processing resources such as a central processing unit (CPU) or hardware or software control logic, ROM, and/or other types of non-volatile memory. Additional components of the information handling system may include one or more disk drives, one or more network ports for communicating with external devices as well as various input and output (I/O) devices, such as a keyboard, a mouse, and a video display. The information handling system may also include one or more buses operable to transmit communications between the various hardware components.

Figure 1:
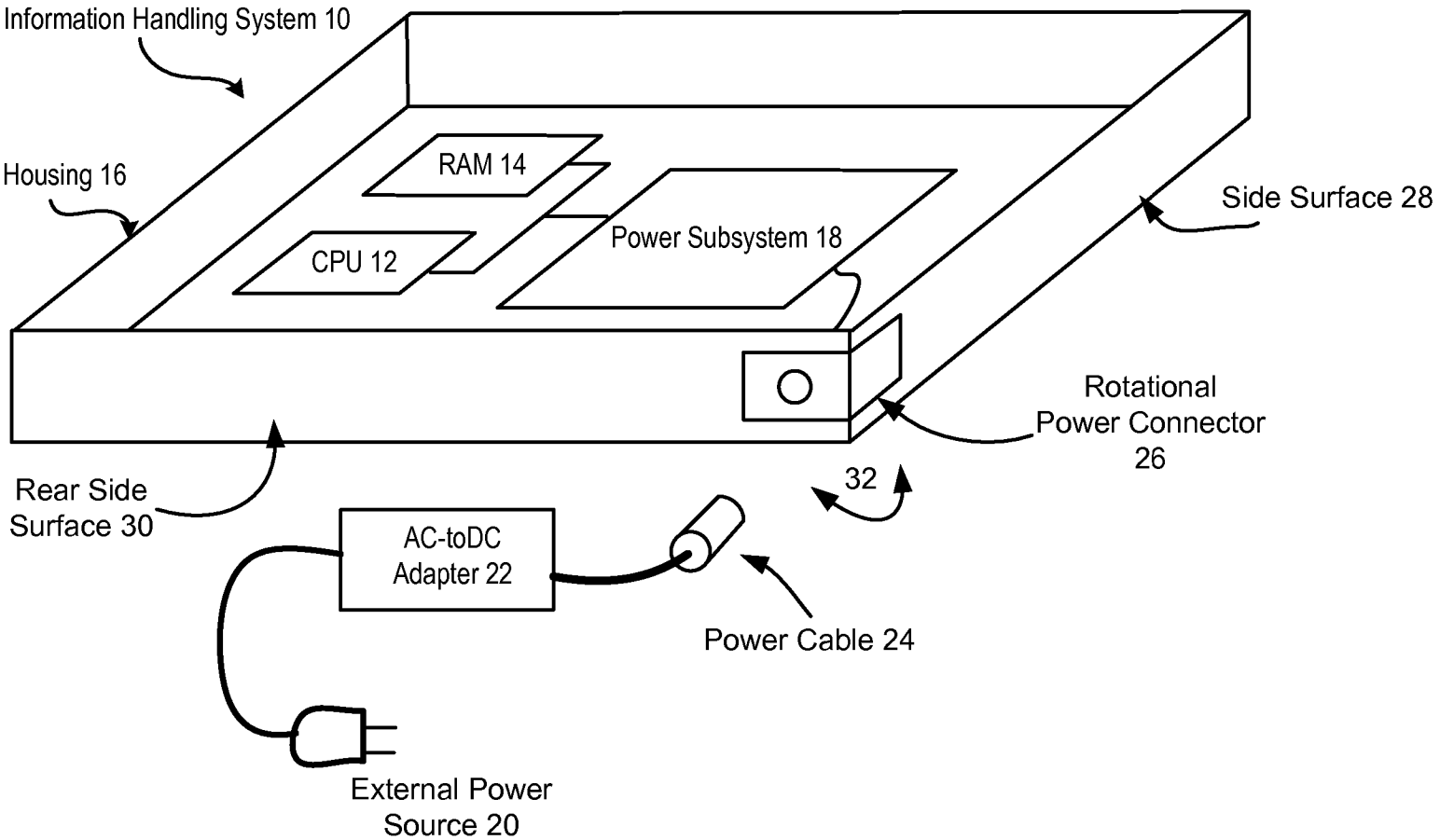
FIG. 1 depicts an upper side perspective view of an information handling system having a rotational connector adapted to rotation about a vertical axis.

Referring now to FIG. 1, an upper side perspective view depicts an information handling system 10 having a rotational connector adapted to rotation about a vertical axis. Information handling system 10 processing information with the coordination of plural processing components, such as a CPU 12 and RAM 14 disposed in a housing 16. The processing components are powered with a power subsystem 18, which receives power from an external power source 20, AC-to-DC adapter 22 and power cable 24 that couples and decouples with a rotational power connector 26. Rotational power connector 26 is integrated in housing 16 at the intersection of a side surface 28 and rear surface 30 of housing 16. Power cable 24 plugs into rotational power connector 26 along an axis perpendicular to rear side surface 30 to provide DC power to power subsystem 18. As is depicted by rotational arrow 32, rotational power connector 26 rotates about a vertical axis so that power cable 24 can extend out perpendicular to either rear side surface 30 or side surface 28 of housing 16. An end user has flexibility to decide what axis to place rotational power connector 26 along. Power cable 24 extends from a desired axis that falls between perpendicular alignment of power cable 24 with rear side surface 30 or side surface 28.

Figure 2:
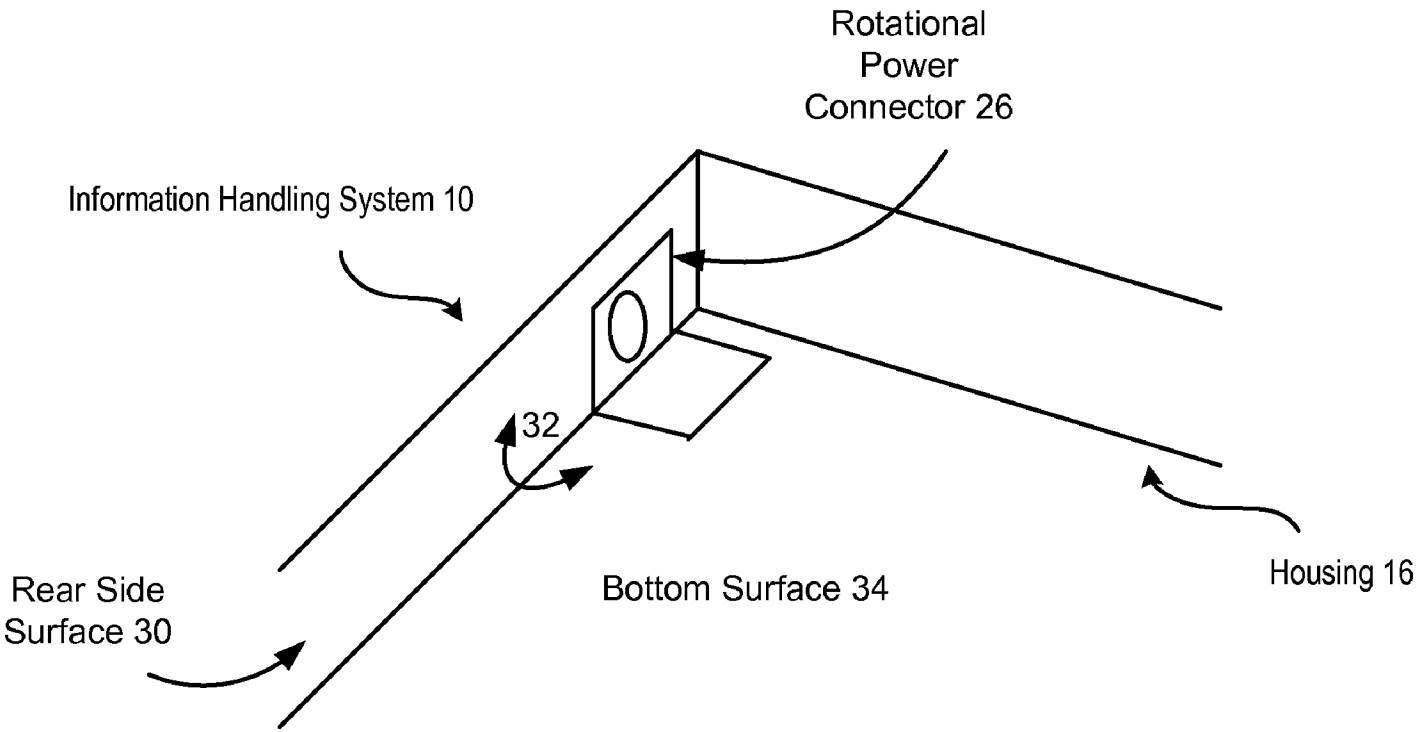
FIG. 2 depicts a lower side perspective view of an information handling system having a rotational connector adapted to rotation about a horizontal axis.

Referring now to FIG. 2, a lower side perspective view depicts an information handling system 10 having a rotational connector 26 adapted to rotation about a horizontal axis. Rotational power connector 26 rotates about arrow 32 so that a power cable couples perpendicular to rear side surface 30 or bottom surface 34. An end user has flexibility to decide what axis to place rotational power connector 26 along. Power cable 24 extends from a desired axis that falls between perpendicular alignment of power cable 24 with rear side surface 30 or bottom surface 34. In alternative embodiments, rotational power connector 26 rotates about both the horizontal and vertical axis to provide greater flexibility in the alignment of power cable 24 between positions perpendicular to rear side surface 30, side surface 28 and bottom surface 34. In alternative embodiments, rotational connector 26 supports cable connections with cables other than power cables, such as Ethernet Cat 5 cables, USB cables, video signal cables, etc.

Figure 3:
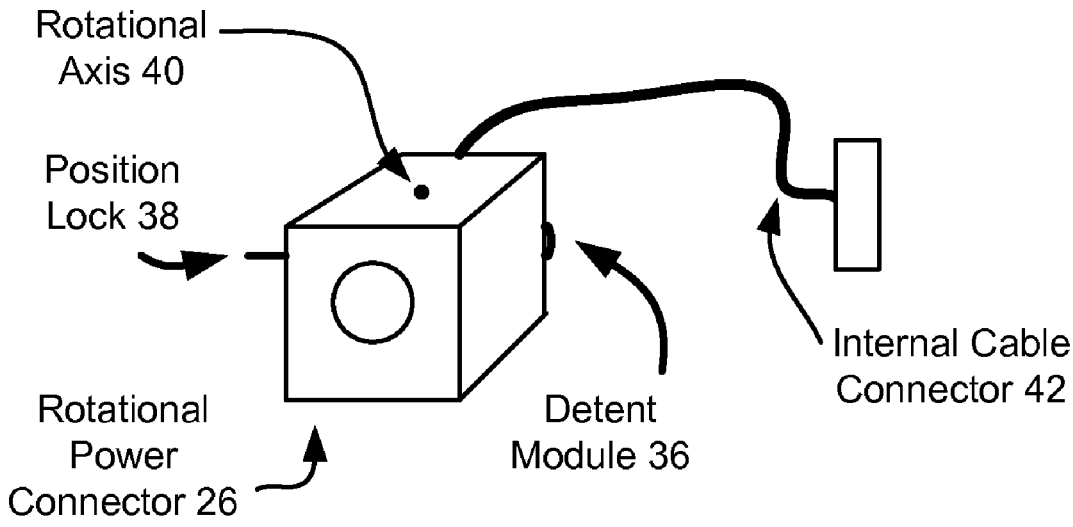
FIG. 3 depicts an upper perspective side view of a rotational connector with a detent module and position lock to selectively restrict rotation.

Referring now to FIG. 3, an upper perspective side view depicts a rotational connector 26 with a detent module 36 and position lock 38 to selectively restrict rotation. Detent module 36 interacts with the side surface of housing 16 so that a detent force must be overcome before rotational power connector 26 will rotate about rotational axis 40. The detent force restricts rotation about rotational axis 40 so that rotation does not occur inadvertently. Position lock 38 interacts with housing 16 to prevent rotation of rotational axis 40. For example, a position lock 38 is included with rotational power connector 26 if a manufacturer desires to set the orientation of rotational power connector 26 at manufacture of an information handling system. An internal cable connector 42 provides cable slack to allow the desired rotational orientation while maintaining communication with power subsystem 18.

Figure 4:
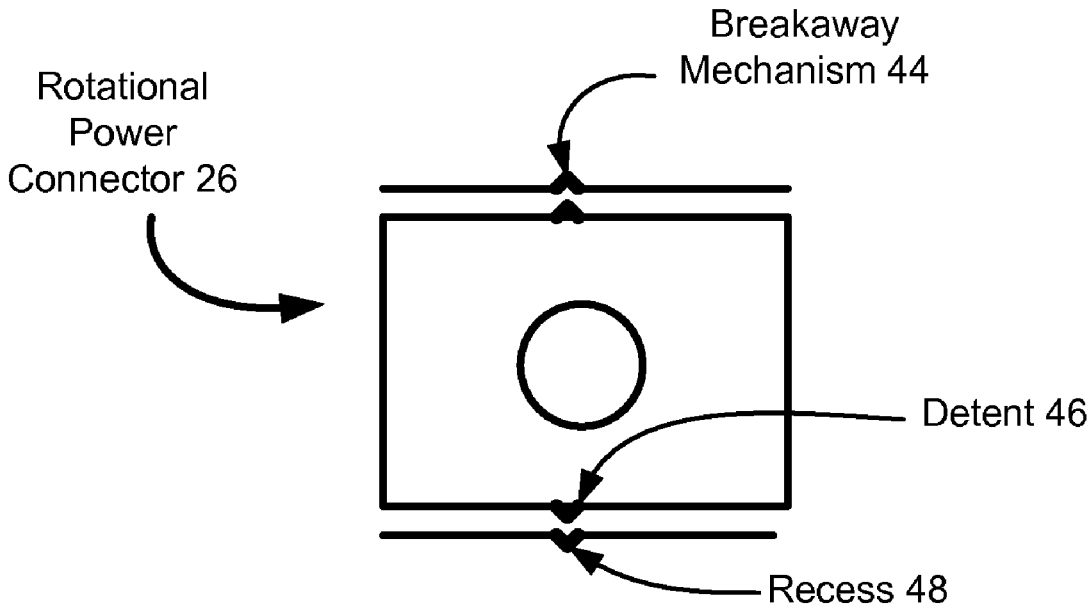
FIG. 4 depicts a front side view of a rotational connector with a detent breakaway mechanism.

Referring now to FIG. 4, a front side view depicts a rotational connector with a detent breakaway mechanism 44. Detents 46 fit into recesses 48 formed in housing 16. During normal operations, rotational power connector 26 rotates about an axis defined between detents 46. Detents 46 are spring-loaded to bias into recesses 48. If a breakaway force is applied to rotational connector 26, the spring-loaded bias of detents 46 is overcome to release from recesses 48 so that rotational connector 26 is freed from housing 16. For example, the breakaway force is a force designed to avoid damage to rotational power connector 26, which might face damage if a more excessive force is applied. In one embodiment, internal cable connector 42 also releases upon the application of a breakaway force so that rotational power connector 26 is completely freed from housing 16. In order to help reduce the risk of damage to information handling system 10, release of rotational connector 26, such as at internal cable connector 42, commands a shutdown of information handling system 10, such as with firmware running on power subsystem 18. In alternative embodiments, a round rotational connector that allows rotation through all three axes may be used in combination with a breakaway device so that a breakaway force applied perpendicular to the rotational connector will result in breakaway of the connector along any axis through which rotation is allowed. For example, a round rotational connector can rotate from side-to-side or bottom-to-back greater than 90 degrees based on the interaction of the cable with the housing surface.

Although the present invention has been described in detail, it should be understood that various changes, substitutions and alterations can be made hereto without departing from the spirit and scope of the invention as defined by the appended claims.

What is claimed is:

1. An information handling system comprising:

a housing having four side surfaces and a bottom surface;

plural components disposed in the housing and operable to process information;

a power subsystem disposed in the housing and operable to power the plural components;

a rotational connector disposed at a side of the housing and interfaced with the power subsystem, the rotational connector operable to couple and decouple with a power cable for providing external power to the power subsystem and to rotate between at least a first and second axis with the power cable coupled to the rotational connector during rotation between the first and second axis;

wherein the first and second axis comprises a first axis that has the power cable perpendicular to a first side surface and a second axis that has the power cable perpendicular to the bottom surface.

2. An information handling system comprising:

a housing having four side surfaces and a bottom surface;

plural components disposed in the housing and operable to process information;

a power subsystem disposed in the housing and operable to power the plural components; and a rotational connector disposed at a side of the housing and interfaced with the power subsystem, the rotational connector operable to couple and decouple with a power cable for providing external power to the power subsystem and to rotate between at least a first and second axis with the power cable coupled to the rotational connector during rotation between the first and second axis;

wherein the rotational connector is located at a corner defined by the intersection of a first and second side of the housing.

3. An information handling system comprising:

a housing having four side surfaces and a bottom surface;

plural components disposed in the housing and operable to process information;

a power subsystem disposed in the housing and operable to power the plural components;

a rotational connector disposed at a side of the housing and interfaced with the power subsystem, the rotational connector operable to couple and decouple with a power cable for providing external power to the power subsystem and to rotate between at least a first and second axis with the power cable coupled to the rotational connector during rotation between the first and second axis; and a breakaway mechanism operable to release the rotational connector from the housing if a breakaway force is applied at the rotational connector;

wherein the breakaway mechanism is further operable to power down the processing components if the rotational connector releases from the housing.

4. A method for providing power to an information handling system, the method comprising:

coupling a cable to connector of the information handling system at a first axis;

providing power through the cable to the information handling system; and applying a force at the cable to move the connector to align the cable at a second axis;

wherein applying a force at the cable to move the connector further comprises rotating the connector from the first to second axis; and wherein the first axis comprises an axis having the power cable perpendicular to a first side of the information handling system and second axis comprises an axis having the power cable perpendicular to a second side of the information handling system.

5. A method for providing power to an information handling system, the method comprising:

coupling a cable to connector of the information handling system at a first axis;

providing power through the cable to the information handling system; and applying a force at the cable to move the connector to align the cable at a second axis;

wherein applying a force at the cable to move the connector further comprises rotating the connector from the first to second axis; and wherein the first axis comprises an axis having the power cable perpendicular to a first side of the information handling system and second axis comprises an axis having the power cable perpendicular to a bottom side of the information handling system.

* * * * *